US005904595A

United States Patent [19]

Tanigawa

[11] Patent Number: 5,904,595

[45] Date of Patent: May 18, 1999

[54] SELF-ALIGNING AND LOCKING SHIELDED CONNECTOR

[75] Inventor: Fumiyoshi Tanigawa, Yokkaichi, Japan

[73] Assignee: Sumitomo Wiring Systems, Ltd., Japan

[21] Appl. No.: 08/924,082

[22] Filed: Aug. 28, 1997

[30] Foreign Application Priority Data

Aug. 28, 1996 [JP] Japan ..... 8-226948

[51] Int. Cl.[6] ..... H01R 9/03

[52] U.S. Cl. ..... 439/610

[58] Field of Search ..... 439/98, 101, 108, 439/607, 608, 610, 701

[56] References Cited

U.S. PATENT DOCUMENTS

| | | | |
|---|---|---|---|
| 5,102,344 | 4/1992 | Tadokoro et al. . | |
| 5,222,909 | 6/1993 | Nomura et al. | 439/271 X |
| 5,618,190 | 4/1997 | Masuda et al. | 439/98 |

*Primary Examiner*—Khiem Nguyen
*Attorney, Agent, or Firm*—Jordan B. Bierman; Bierman, Muserlian and Lucas

[57] ABSTRACT

The connector housing carries a radially outwardly extending flange at its perimeter. The flange is provided with a guide surface, tapered towards the rear of the connector, whereby the shield cover is aligned. This prevents the leading edge of the shell.

6 Claims, 8 Drawing Sheets

SELF-ALIGNING AND LOCKING SHIELDED CONNECTOR

This Application claims the benefit of the priority of Japanese Application 8/226,948, filed Aug. 28, 1996.

The present Invention is directed to an improved shielded connector wherein shielded cables may be interconnected; more specifically, it is directed to a connector which is both self aligning and locking.

BACKGROUND OF THE INVENTION

In shielded connectors of this general type, a shield cover is fitted onto a shield shell by axial movement. The inner surface of the shield cover is in frictional contact with the outer surface of the shield shell. The leading edge of the cover slides against the trailing edge of the shell with virtually no gap therebetween. As a result, even a slight offset in positioning the cover and shell is sufficient to prevent the former from being slid over the latter. This is particularly true if any inwardly directed flashing remains on the leading end of the cover. This is likely to catch against the shell, making it even more difficult to assemble. It is an object of the present Invention to overcome this problem and improve the assembly of the connector, particularly the insertion of the shield cover over the shield shell.

SUMMARY OF THE INVENTION

The shielded connector of the present Invention is intended for use with a shielded cable which comprises an electrically conductive core wire, an insulating layer surrounding the wire, an electrically conductive shield surrounding the insulating layer, and a sheath surrounding the shield. The connector comprises a male connector and a complementary female connector.

The male connector comprises a housing and a male terminal therein. The terminal has a contact with the distal end extending toward the front of the housing. The proximal end of the contact is remote from the distal end and the terminal is electrically connected to the core wire at the proximal end. A shell surrounds the housing and is in electrical contact therewith, and a shield cover at least partially surrounds the shell and is in electrical contact with both the shield and the shell.

The rear end of the housing, axially remote from the front, carries a flange on its perimeter adjacent the rear end. The flange extends radially outwardly and is provided with a guide surface which tapers toward the rear end. As a result, as the shield cover is axially moved onto the housing, the guide surface directs the leading edge of the shield cover into alignment with the outer surface of the housing. Thus, misalignment is prevented —or at least minimized—so that the shell and housing can be readily assembled.

In a preferred form of the Invention, there is a holder surrounding the male connector which has a resilient lance thereon. The lance extends toward the rear end and terminates in a lance end. There is a claw adjacent the lance end which protrudes radially inwardly from the lance. A corresponding abutment is mounted on the housing adjacent its perimeter so that the claw engages the abutment upon assembly. This prevents accidental withdrawal of the housing from the holder.

In a further embodiment of the present Invention, the outer surface of the housing is provided with a pair of ribs which are radially outwardly protruding. The ribs extend parallel to the axis of the housing and are circumferentially spaced apart from each other. Correspondingly, there is a pair of guide grooves in the shell which is complementary to the ribs. When the shell is moved onto the housing, the ribs slide into the grooves and secure the two elements together. Preferably, the guide grooves are provided with a portion of reduced width; this permits the edges of the grooves to frictionally engage the ribs and minimize the chance for unwanted movement of the housing and shell relative to each other. It has been found advantageous to locate the abutment (which is engaged by the lance) between the ribs.

BRIEF DESCRIPTION OF THE DRAWINGS

In the accompanying drawings, in which like reference characters indicate like parts.

DETAILED DESCRIPTION OF THE INVENTION

Figure 1:
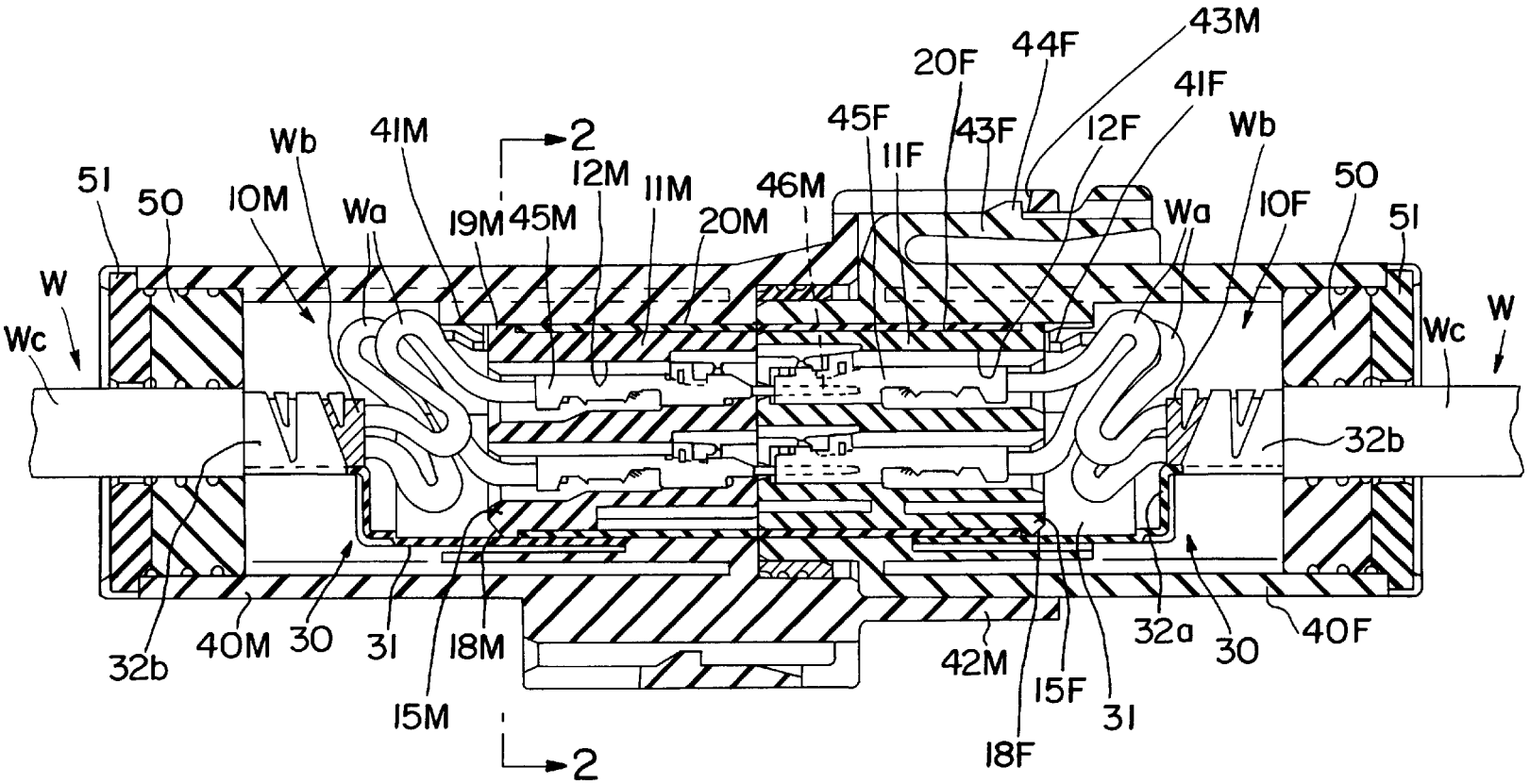
FIG. 1 is a cross sectional view of the male and female connectors locked together.
Figure 2:
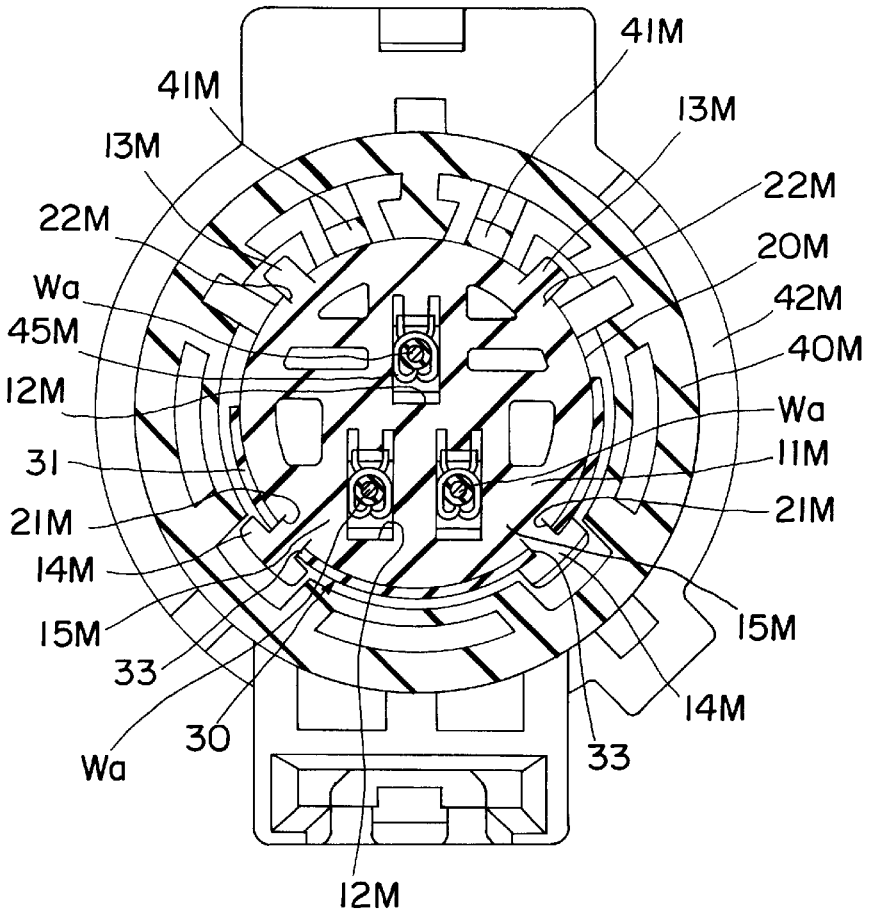
FIG. 2 is a cross sectional view along line A—A of FIG. 1.
Figure 3:
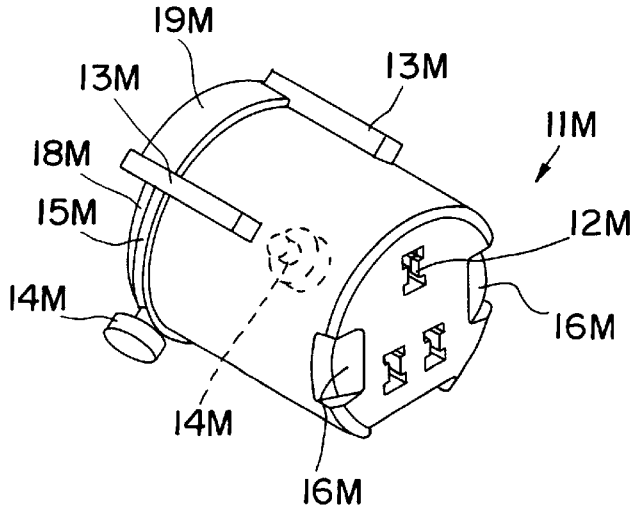
FIG. 3 is a perspective view of the male housing.
Figure 4:
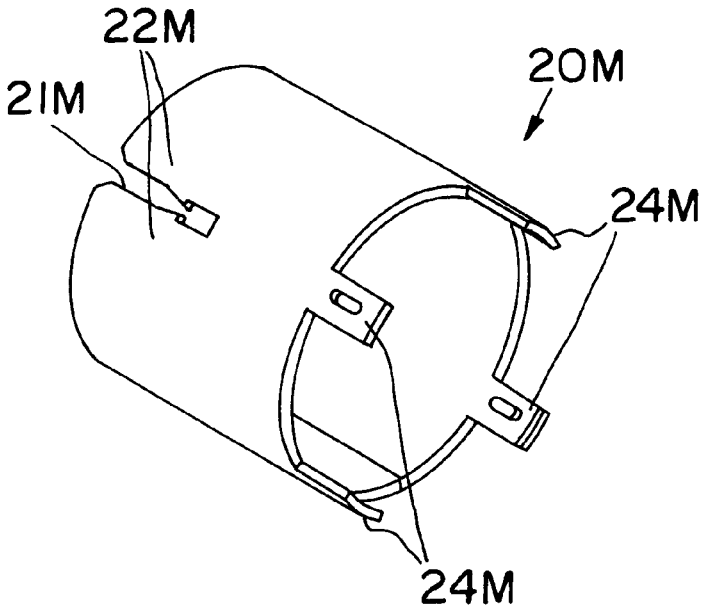
FIG. 4 is a perspective view of the male shell.
Figure 5:
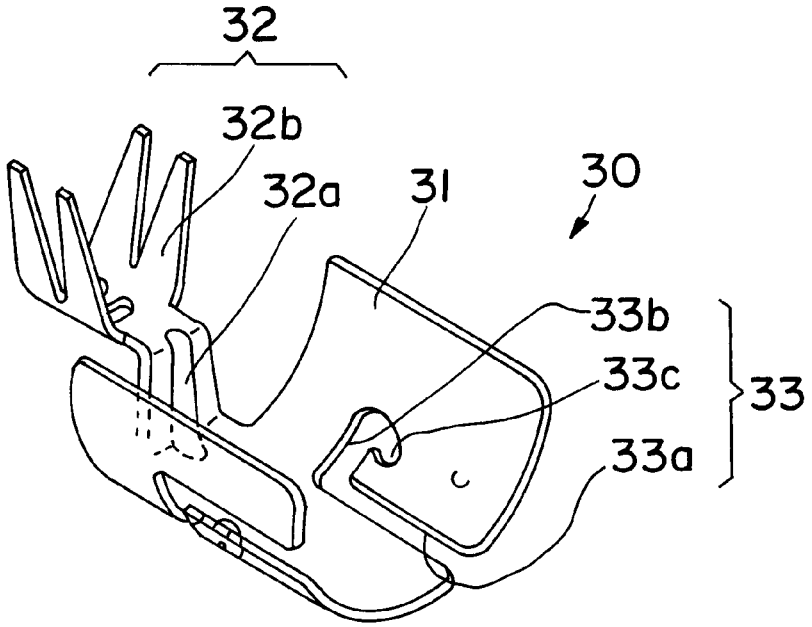
FIG. 5 is a perspective view of the male shield cover.
Figure 6:
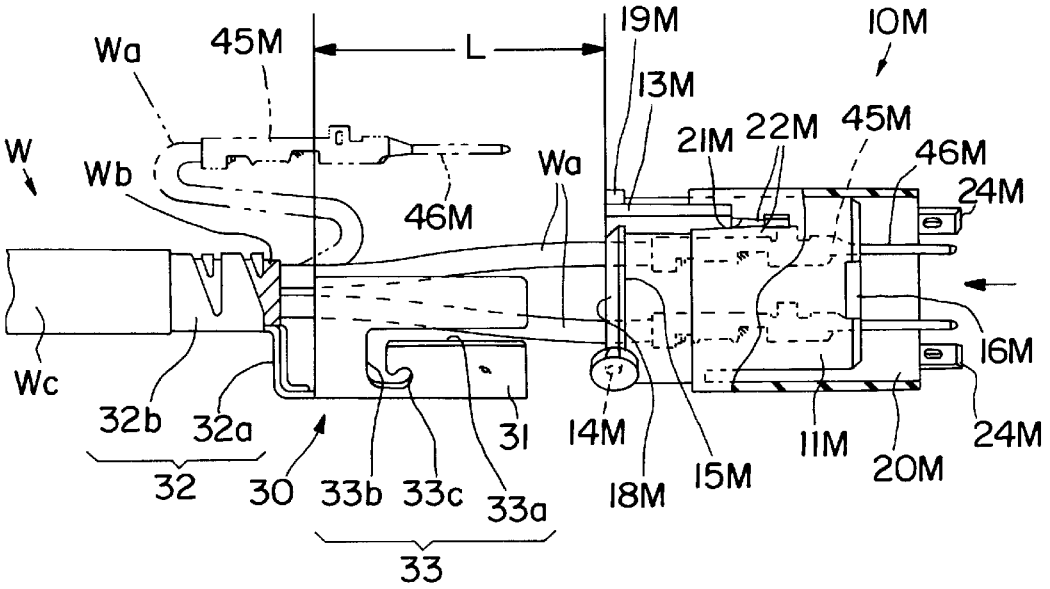
FIG. 6 is a diagrammatic cross sectional view of the first stage of assembling the male connector.

The shielded connector of the present Invention comprises male connector 10M and female connector 10F. Since the two connectors are substantially alike with respect to the present Invention, the reference numerals a re the same in both cases, the only difference being the use of "M" for the male connector and "F" for the female connector. In view thereof, the description will refer to the reference numerals without suffixes (unless the context so requires) and it is understood that the corresponding parts of both halves of the shielded connector are intended.

The shielded connector is intended for use in connection with shielded cable W which is made up of core wires Wa, shield Wb, and sheath Wc. Core wires Wa are surrounded by an insulating layer. Connector 10 comprises housing 11 within which terminals 45 are located. Male terminal 45M is provided with male contact 46M while the corresponding female terminal 45F is adapted to receive contact 46. This is the only substantial difference between the male and female connectors.

Housing 11 contains cavities 12 within which terminals 45 are located. Projections 14 extend radially outwardly from the surface of housing 11 and serve to retain other portions of the connector in place. Flange 15 is peripherally located adjacent the rear end of housing 11 and is provided with guide surface 18 which tapers toward the rear end. Positioning cavities 16 are on the leading end.

Shell 20 surrounds housing 11 and has guide grooves 21 which are complementary to ribs 13. Reduced width portions 22 grip ribs 13 and minimize or eliminate the chance of shell 20 and housing 11 inadvertently separating. Shell 20 carries contact portions 24M which are received in escaper cavities 17F on the corresponding female connector housing 11F.

Shield cover 30 comprises main unit 31 and contact section 32. More specifically, contact section 32 includes barrel 32*b* and bent section 32*a*. The former is crimped around shield Wb and sheath Wc, thereby insuring good electrical contact. The other end of shield cover 30 is provided with engagement grooves 33 which are made up of straight guide section 33*a*, bent section 33*b*, and retaining section 33*c*.

As is more particularly shown in FIGS. 6, 7, 10, and 11, to assemble the device, cable Wc is first stripped to expose both core wires Wa and shield Wb. Terminals 45 are crimped onto core wires Wa and barrel 32*b* is crimped onto sheath Wc and shield Wb. This provides good electrical contact between the shield and shield cover 30 as well as between core wires Wa and terminal 45. Terminals 45 are introduced into housing 11 and shell 20 is slid thereover from the front. When this is done, ribs 13 enter guide grooves 21 and reduced width portions 22.

Shield cover 30 is brought into contact with guide surface 18 of flange 15 which aligns it with housing 11. At the same time, projections 14 enter straight sections 33*a* of grooves 33. This axial movement is continued until projections 14 reach bent section 33*b*. At this point, shell 20 and housing 11 are rotated counter-clockwise about their common axis. This causes projections 14 to enter retaining section 33*c*.

Figure 7:
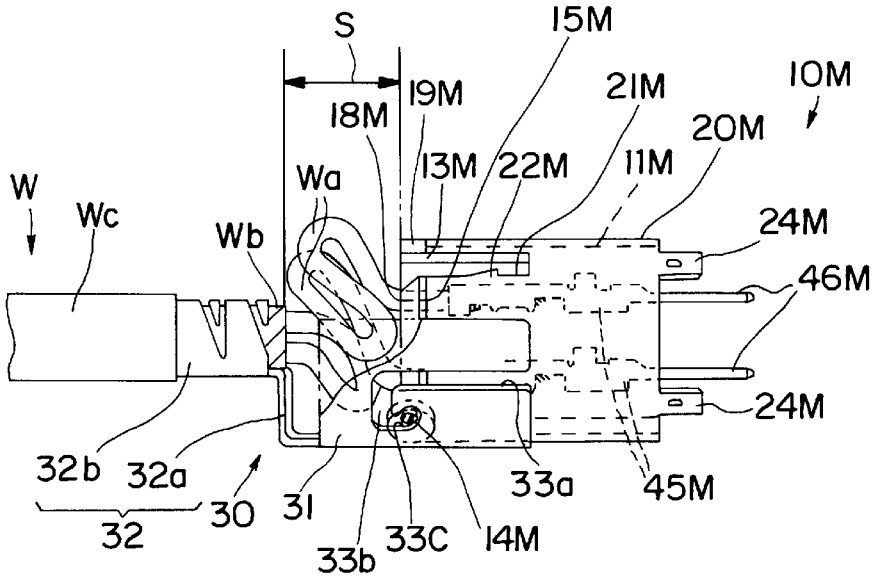
FIG. 7 is a view, similar to that of FIG. 6, of the male connector fully assembled.
Figure 8:
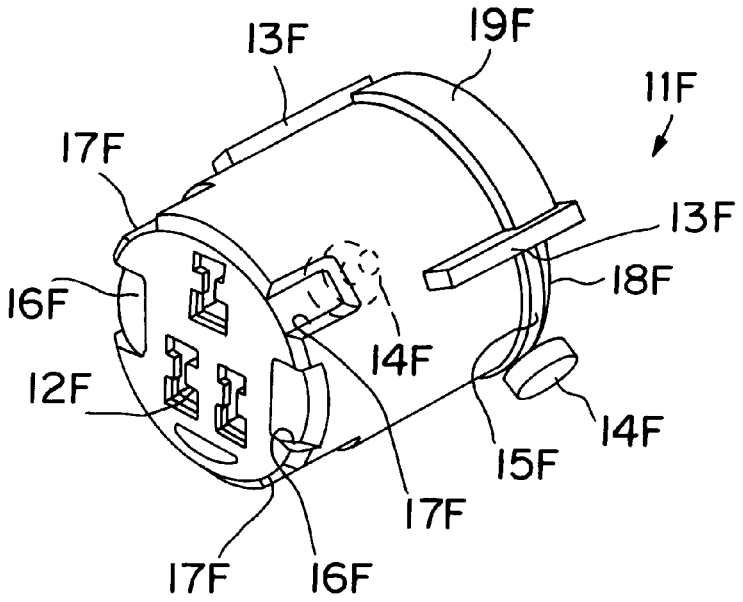
FIG. 8 is a view, similar to that of FIG. 3, of the female housing.
Figure 9:
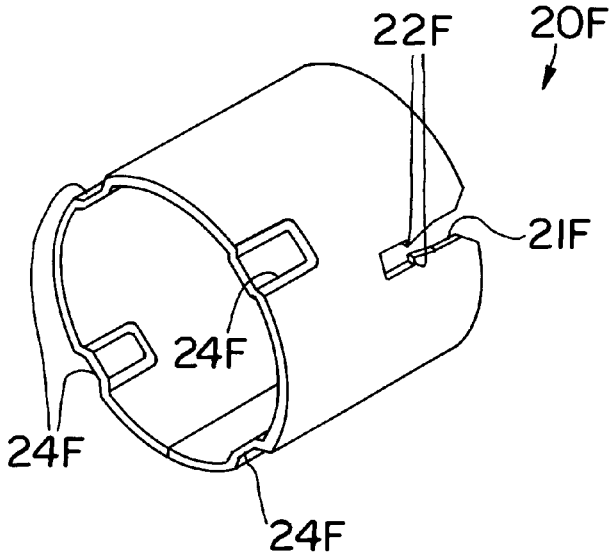
FIG. 9 is a view, similar to that of FIG. 4, of the female shell.
Figure 10:
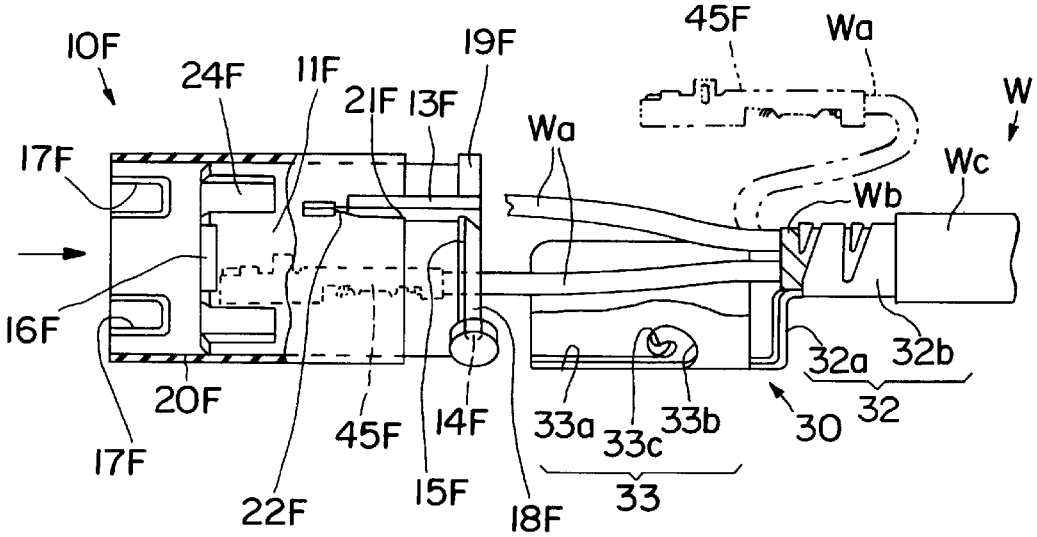
FIG. 10 is a view, similar to that of FIG. 6, of the female connector.
Figure 11:
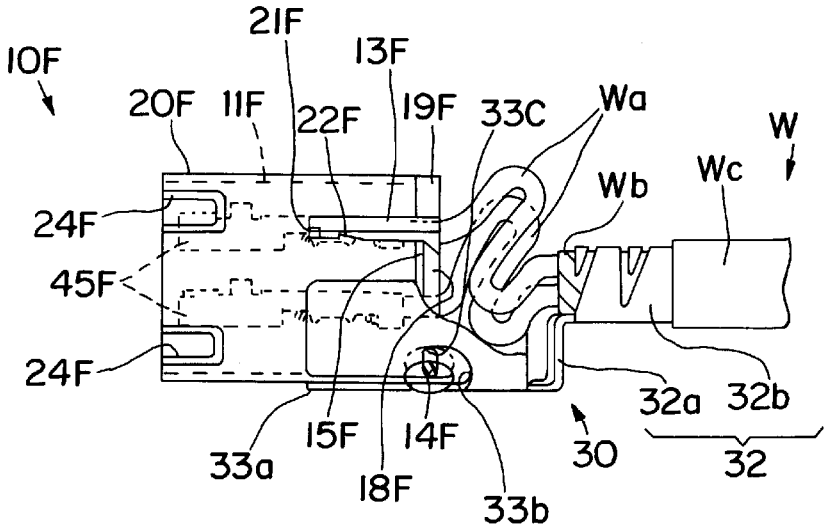
FIG. 11 is a view, similar to that of FIG. 7, of the female connector.
Figure 12:
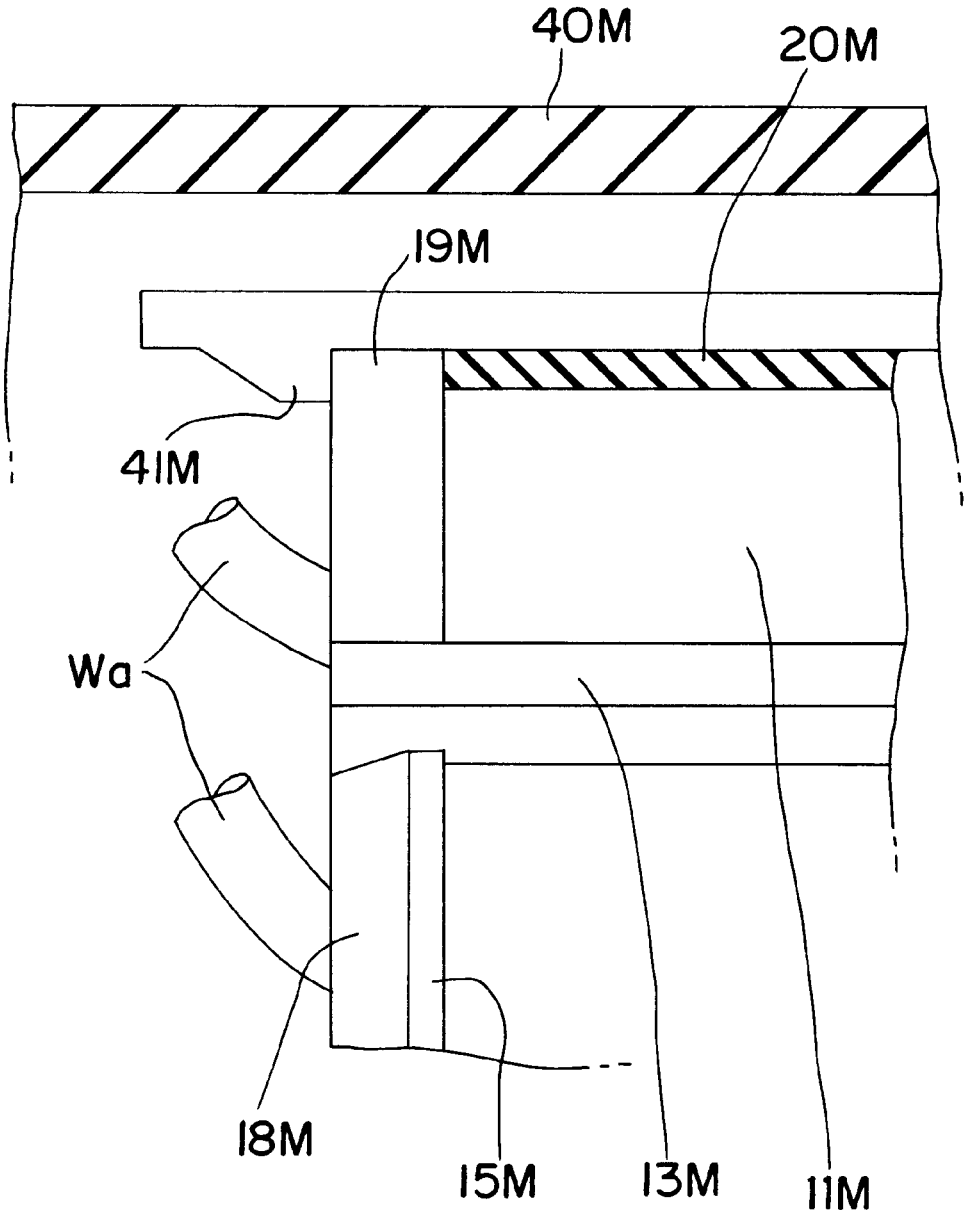
FIG. 12 is an enlarged fragmentary cross sectional view of the female connector in its partially assembled state.
Figure 13:
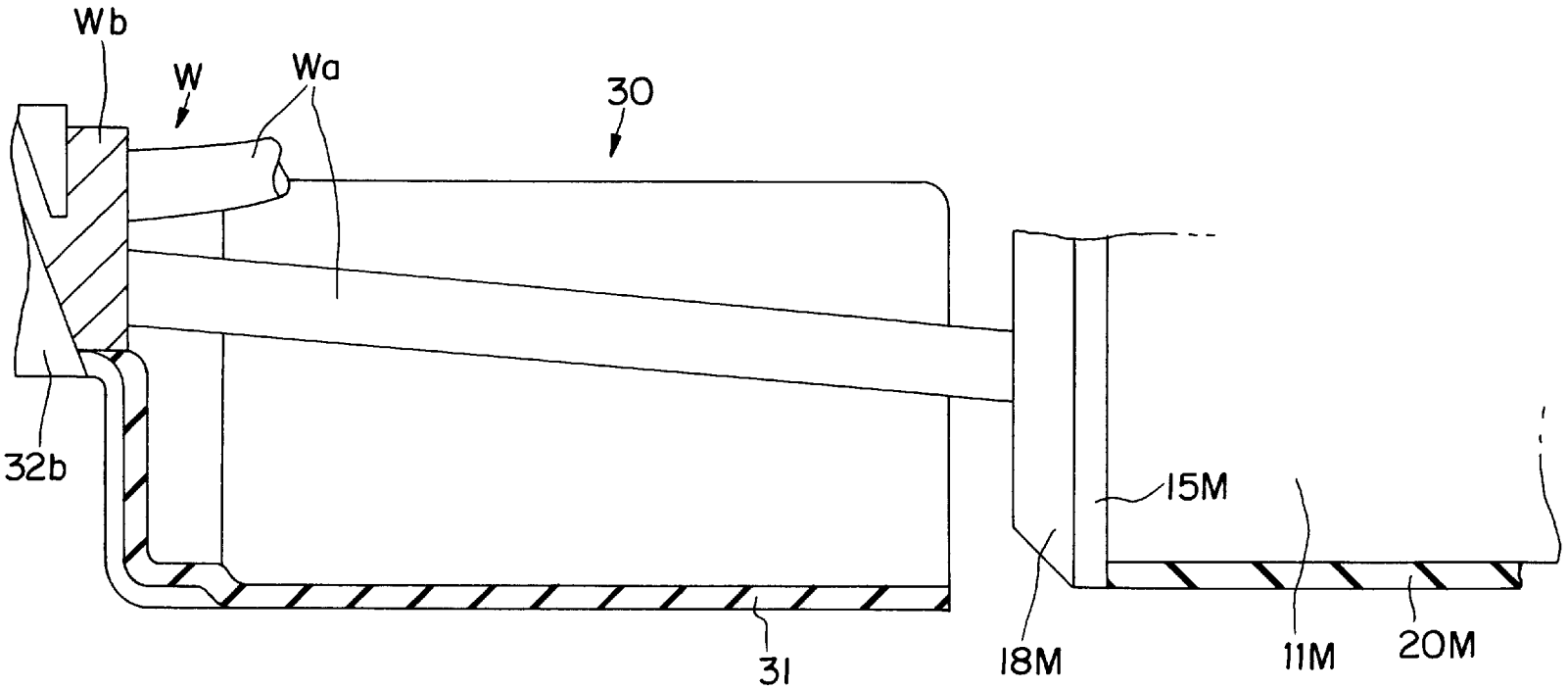
FIG. 13 is an enlarged fragmentary cross sectional view of the male connector in its partially assembled state.

As shown in FIG. 7, length S between the leading edge of cable W and the rear edge of housing 11 is substantially less than length L. As a result, core wires Wa are compressed and, since they have a certain amount of resilience, exert a separating force between cable W (and shield cover 30 which is crimped thereto) on the one hand and housing 11 and shell 20 on the other. This causes projections 14 to be locked into retaining section 33C. In other words, it is a feature of the present Invention that core wires Wa are longer than the distance between shell 40 and housing 11 when in the assembled state. Their resilience provides pressure in the separation direction which urges projections 14 into retaining sections 33*c* of grooves 33. This not only makes the overall longitudinal dimension shorter, but also provides that protuberances 14 are securely held in grooves 33.

When both halves of the connector have been assembled as aforesaid, they are introduced into holder 40 from the rear in each case. The claw at the end of lance 41 passes over abutment 19 and bears against the face thereof, thereby preventing housing 11 from being withdrawn. Both halves of the connector mate, with contacts 46 entering female terminals 45F and contact portions 24M entering contact cavities 24F. Thereafter, water-proof rubber stoppers 50 and pressure rings 51 (which were previously placed on cables W) are inserted into the rear ends of holder 40.

In this embodiment, main unit 31 of shield cover 30 is a partial cylinder. Hence, between shield Wb and shell 20, core wires Wa are unshielded from above as shown in FIG. 1. However, because wires Wa are bent, as shown (for example) in FIG. 7, length S is relatively short and no substantial decrease in shielding effect is encountered.

While only a limited number of specific embodiments of the present Invention have been expressly disclosed, it is intended to be broad in scope and such modifications as would be apparent to the person of ordinary skill may be made without departing from the spirit thereof. For example, main unit 31 of shield cover 30 is shown as a partial cylinder. However, it is readily contemplated that main unit 31 be a complete cylinder, surrounding the entire perimeter of core wires Wa.

As shown herein, the shield is a cylindrical wire mesh woven from thin conductive metal wires. However, it is within the scope of the present Invention to form the shield by other recognized means, e.g. wrapping metal foil around the core wires, coating them by vaporization, or plasma spray coating. Alternatively, the wires could be spirally wound.

Thus, the present Invention is to be broadly construed and not to be limited except by the character of the claims appended hereto.

What we claim is:

1. A shielded connector for use with a shielded cable which comprises an electrically conductive core wire, an insulating layer surrounding said core wire, an electrically conductive shield surrounding said insulating layer, and a sheath surrounding said shield, said shielded connector comprising a first connector and a second connector complementary thereto;

said first connector comprising a housing, a terminal in said housing, and said terminal having a contact with a distal end extending toward a front of said housing and a proximal end remote from said distal end, said terminal being electrically connected to said core wire;

a shell surrounding said housing and in electrical contact therewith, a shield cover at least partly surrounding said shell and in electrical contact with said shield and said shell;

a rear end of said housing, axially remote from said front, a flange on a perimeter of said housing adjacent said rear end and extending radially outwardly therefrom, said flange having a guide surface tapering toward said rear end whereby, as said shield cover is moved axially onto said housing, said guide surface aligns a leading edge of said shield cover with an outer surface of said housing;

an outer surface of said housing being provided with a pair of radially outwardly protruding, axially extending, circumferentially spaced apart ribs, guide grooves in said shell which are complementary to said ribs, whereby said ribs protrude into said grooves, an abutment extends circumferentially between said pair of ribs.

2. The shielded connector of claim 1 comprising a holder surrounding said first connector, a resilient lance on said holder extending toward said rear end and terminating in a lance end, a claw adjacent said lance end and protruding radially inwardly from said lance, said claw engaging said abutment, whereby withdrawal of said housing from said holder is prevented.

3. The shielded connector of claim 1 wherein said shield cover has a barrel at its end remote from said front, said barrel being crimped around said shield.

4. The shielded connector of claim 1 wherein there is a plurality of first terminals in said housing.

5. The shielded connector of claim 1 wherein at least one of said guide grooves has a reduced width portion which bears against sides of one of said ribs, thereby frictionally reducing slippage of said housing and said shell relative to each other.

6. The shielded connector of claim 1 wherein said shield is a metallic mesh.

* * * * *